United States Patent [19]

Herden et al.

[11] Patent Number: 4,613,789

[45] Date of Patent: Sep. 23, 1986

[54] SPARK PLUG WITH CAPACITOR SPARK DISCHARGE

[75] Inventors: Werner Herden, Gerlingen; Werner Bloss, Winterbach, both of Fed. Rep. of Germany

[73] Assignee: Robert Bosch GmbH, Stuttgart, Fed. Rep. of Germany

[21] Appl. No.: 671,555

[22] Filed: Nov. 15, 1984

[30] Foreign Application Priority Data

Dec. 24, 1983 [DE] Fed. Rep. of Germany ..... 3347027

[51] Int. Cl.[4] ..... H01J 7/44

[52] U.S. Cl. ..... 315/58; 313/637

[58] Field of Search ..... 313/637; 315/58

[56] References Cited

U.S. PATENT DOCUMENTS

| | | | |
|---|---|---|---|
| 1,286,316 | 12/1918 | Hewitt | 313/637 |
| 1,704,781 | 3/1929 | Aspden | 315/58.1 |
| 2,103,038 | 12/1937 | Moers | 313/637 |
| 2,376,362 | 5/1945 | Kasarjian | 315/58 |
| 3,267,325 | 8/1966 | Why | 315/58 |
| 3,443,142 | 5/1969 | Koppl et al. | 315/58 |
| 4,549,114 | 10/1985 | Herden | 313/123 |

FOREIGN PATENT DOCUMENTS 2810159 9/1979 Fed. Rep. of Germany .

*Primary Examiner*—Harold Dixon

*Attorney, Agent, or Firm*—Frishauf, Holtz, Goodman & Woodward

[57] ABSTRACT

A spark plug which has a capacitor located therein, connected in parallel to the main or ignition spark gap (13), additional includes a pilot or pre-spark gap (12) located within the insulator (18) of the spark gap, to control discharge of the capacitor (14) through the main spark gap (13). In accordance with the invention, the pre-spark gap (12) is located within a chamber (34) in the insulator which is filled with a pressurized gas, preferably nitrogen under pressure of between 2 to 100 bar, preferably 5 to 30 bar, with the electrodes (27, 27) defining the pre-spark gap being spaced, preferably, between about 0.1 to 1 mm from each other. Placing the pre-spark gap electrodes within a pressurized gas chamber increases the energy available at the main spark gap (13) for ignition even of very lean fuel-air mixtures. Preferably, an inductive-resistive circuit (15) is connected in shunt across the main electrode (13) to prevent arcing and glow discharges across the main spark gap (13) after the initial ignition spark.

19 Claims, 2 Drawing Figures

SPARK PLUG WITH CAPACITOR SPARK DISCHARGE

Reference to related application, assigned to the assignee of this application:

U.S. Ser. No. 649,989, filed Sept. 13, 1984, Herden et al.

Reference to related disclosure:

German Patent Disclosure Document No. 28 10 159, Albrecht et al.

The present invention relates to a spark plug, and more particularly to a spark plug for use in combination with an Otto-type internal combustion engine, which has a capacitor being charged by current flowing to the spark plug and discharging via the spark gap of the spark plug under control of a pre-spark gap upon breakdown of the pre-spark gap.

BACKGROUND

Spark plugs which have pre-spark gaps to discharge a capacitor and thereby apply the energy stored in the capacitor to the main spark gap have previously been proposed, see, for example, U.S. Ser. No. 649,989, filed Sept. 13, 1984, Herden et al.

Spark plugs which have pre-spark/or pilot spark gaps and capacitors as described are particularly suitable for reliably igniting even very lean fuel-air mixtures which provides for excellent energy transfer from the mixture to the engine, and insures complete combustion of any fuel in the fuel-air mixture. Complete combustion results in low polluting emissions from the engine and high utilization of the fuel being used. Spark plugs of this type have the additional advantage that they are directly replaceable with conventional spark plugs in engines having any type of ignition system. Reliable ignition of even lean fuel-air mixtures is obtained by converting a substantial portion of the available ignition energy during the breakdown phase of the initial phase of the spark itself.

It has been found that the pre-spark gap, which controls discharge of the capacitor within the spark plug, does cause some loss in energy which, most desirably, should be transferred to the main spark gap itself. The pre-spark, thus, reduces the available ignition energy which, in the end, causes burning of the fuel-air mixture within the combustion chamber of the engine.

THE INVENTION

It is an object to further improve the efficiency of energy transfer supplied to the spark plug by reducing lost energy within a pre-spark gap controlling discharge of a capacitor across the main or ignition spark gap.

Briefly, the spark plug is constructed in conventional form, with an internal chamber formed therein, preferably within the central insulator, in which a pre-spark/or pilot spark gap is located. In accordance with the invention, the pre-spark gap is filled with a gas under pressure, preferably nitrogen under a gas pressure of from between 2 to 100 bar, preferably between about 5 to 30 bar. The electrodes of the pre-spark gap then may have a spacing of between 0.05 to 2 mm, preferably in the order of about 0.1 to 1 mm.

DRAWINGS

FIG. 1 is a schematic diagram of an ignition system with which the spark plug of the present invention can be used, including an equivalent electrical network diagram of the spark plug; and FIG. 2 is a longitudinal sectional view through the spark plug in accordance with the invention.

DETAILED DESCRIPTION

Figure 1:
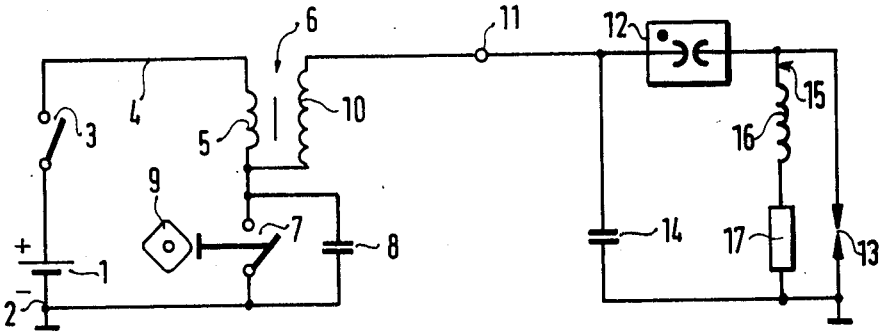

The ignition system of FIG. 1 is intended to be used with an Otto-type internal combustion engine, not shown, for example for use in an automotive vehicle. The ignition system is shown only highly schematically, and only those components necessary for an understanding of the invention are illustrated.

A direct current source 1 which may, for example, be a vehicular battery, is connected with its negative terminal 2 to ground or chassis. The positive terminal is connected through a main or ignition switch 3 to a supply bus 4. The positive supply bus 4 is connected to a brach circuit which includes the primary winding 5 of an ignition coil 6, then, serially connected, an interruptor or breaker switch 7, and through the switch 7 to ground. A breaker spark suppression capacitor 8 is connected across the breaker terminals. The breaker terminals are controlled to open at an ignition instant under control of a cam 9. The secondary winding 10 of the ignition coil 6 is connected with one terminal to the junction between the primary winding 5 and the breaker switch 7; the other terminal winding is connected to a spark ignition terminal 11.

Any other type of ignition system may be used, for example electronically controlled, capacitor discharge types and the like, and, for multiple-cylinder engines, with a distributor. The essential feature being that a terminal 11 is available for connection to the spark plug.

The equivalent circuit of the spark plug is shown to the right—with respect to FIG. 1—of terminal 11. From terminal 11, a connection is made through a pre-spark gap 12, and then through the main or ignition gap 13 to ground or chassis. The serial connection of the pre-spark gap 12 and the ignition spark gap 13 has a capacitor 14 connected in parallel thereto. It is desirable, but not necessary, to connect, further, a shunt branch circuit 15 in parallel to the ignition spark gap 13. The shunt branch 15 has an inductive component 16 and a resistive component 17. The equivalent circuit shows the inductive and resistive components separately; the resistive component 17 may be formed by the inherent resistance of a coil 16 and/or a resistor serially connected to the coil 16.

Figure 2:
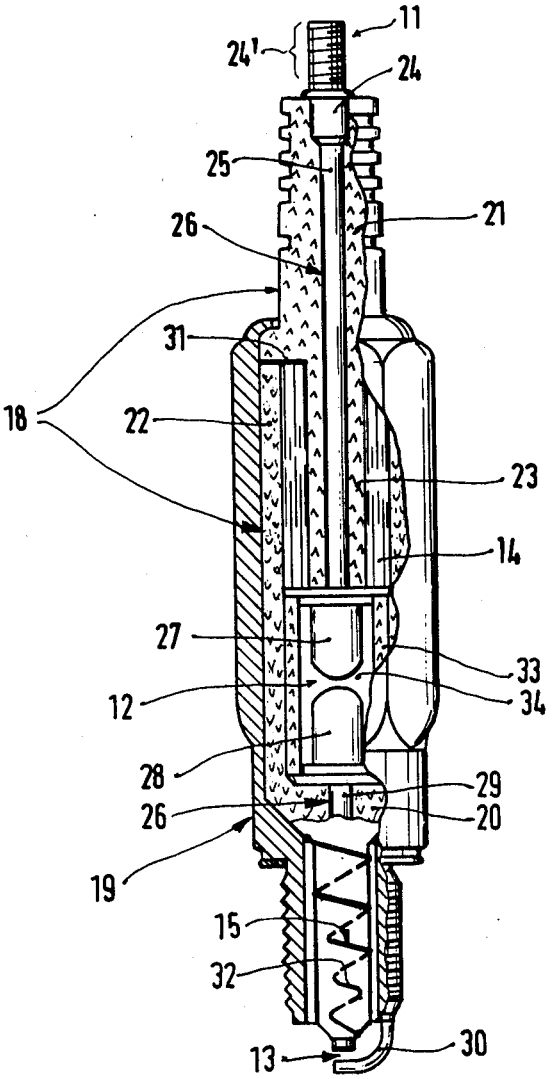

The high-voltage terminal 11, pre-spark gap 12, ignition spark gap 13, capacitor 14 and, if provided the shunt branch 15 are located within one structural unit forming the spark plug itself shown, in a representative and typical arrangement, in FIG. 2. FIG. 2 illustrates a spark plug which has the conventional shape, and adapted to be screwed into the spark plug opening within the cylinder head of an Otto-type internal combustion (IC) engine. The spark plug includes, besides the elements 11–14 and, if used, 15, 16 and 17, additionally an insulator 18 and a metal housing 19 which retains all the elements within the metal housing of the spark plug.

The insulator 18 is elongated and of circular cross section. It has a spark portion 20 and a head portion 21. The two portions 20, 21 overlap. End portions 20 extends telescopically within head portion 21. The overlap is formed by sleeve-like portions 22, 23, which are axially spaced from each other, to provide a ring-shaped space of circular cross section to receive the capacitor 14. The capacitor 14, preferably, is a foil-type capacitor which is a wound hollow cylinder and, at its facing ends, is formed with electrical terminations to provide electrical connection to the respective components of the spark plug.

The high-voltage connection 11 is formed by a bolt 24, secured in the head portion 21 of the insulator 18, and formed with a threaded end 24' extending from the head portion 21 of the insulator. The high-voltage terminal 11 is extended within the head portion 21 to form a first portion 25 of a center electrode 26. The first portion 25 of the center electrode 26, having at one end the high-voltage terminal 11, is connected at its other facing end to an electrode 27 of the pre-spark gap 12. The counter-electrode 28 of the pre-spark gap 12 is connected or forms part of a second portion 29 of the center electrode 26. The other end portion of the section 29 projects from the base portion 20 of the insulator 18 to form the center electrode of the main or ignition spark gap 13. The ignition spark gap 13 is formed, as well known and customary, by an opposed hook 30 projecting from the threaded metal end portion of the metal housing 19. The metal housing is shaped internally in such a manner that the insulator elements are held together; the upper end of the metal housing is rolled over to secure the head insulator portion in position and against the base insulator portion 22. Sealing elements and the like have been omitted for clarity, since the general overall structure of the spark plug is known.

The capacitor 14 has its upper (with respect to FIG. 2) end face connected to the metal housing, as schematically indicated by the connecting terminal line 31; its lower end face is connected to a laterally projecting flange formed on the pre-spark gap terminal 27, thereby, electrically, connecting the capacitor across the series circuit of the pre-spark gap 12 and the ignition spark gap 13, as shown in FIG. 1.

The shunt branch 15 is formed, for example, by a spiral 32 of electrically conductive material which is located between the metal housing 19 and surrounding the projecting base portion 20 of the insulator surrounding the lower portion 29 of the center electrode 26. The conductor of the spiral 32 is so selected that the inductive and resistive components 16, 17 (FIG. 1) are obtained. The conductor 32 may be embedded within the insulator, or wrapped thereabout, or positioned, essentially, on the outside of the insulator with a coating thereover.

The discharge circuit, which includes the elements 12, 13, 14, is designed with respect to high-frequency circuit design, in other words, that its inductivity is as low as possible and its ohmic resistance, likewise, is as low as possible.

The bolt 24 which forms the high-voltage terminal 11, the first portion 25 of the center electrode 26, the electrodes 27, 28 of the pre-spark gap 12, and the second portion 29 of the center electrode 26 are so located within the insulator 18 that their longitudinal axes are congruent with the central longitudinal axis of the insulator 18. A sleeve 33 is provided to determine the spacing of the electrodes 27, 28 which form the pre-spark gap 12. The electrodes 27, 28 are cylindrical and rounded at their facing sides, as best seen in FIG. 2.

The electrodes 27, 28 are located within a chamber 34 defined within the insulator 18. Their spacing defines the pilot spark gap.

In accordance with a feature of the invention, the chamber 34 is subjected to gas under pressure. In accordance with a preferred embodiment of the invention, the gas is nitrogen, and the gas pressure is between 2 to 100 bar, preferably between 5 to 30 bar. The electrodes 27, 28 which, for example, are made of copper, are preferably spaced from each other by between about 0.05 to 2 mm. preferably by about 0.1 to 1 mm.

OPERATION

Upon closing of the main switch 3 (FIG. 1), the ignition system is ready for generating sparks in the ignition chamber of an ICE. Upon opening of the breaker switch 7—or, if a transistorized ignition is provided, upon controlling a transistor to blocking or non-conduction—current flowing through primary winding 5 is suddenly interrupted and a highvoltage pulse is induced in the secondary winding 10 which is connected to the high-voltage terminal 11. This charges the capacitor 14 until the pre-spark gap 12 breaks down. Upon breakdown, a high-energy ignition spark is generated at the ignition spark gap 13 within a few nanoseconds. This results in reliable ignition of fuel-air mixture within the combustion chamber of the engine, even if the fuel-air mixture is lean. Consequently, the energy recovery from the fuel within the fuel-air mixture is high, the mixture is completely burned, and the resulting exhaust gases from the engine have a minimum of polluting components.

The branch circuit 15 which, preferably, is provided, counteracts the occurrence of low discharges and extended arcing at the electrodes, thus reducing burning-off of material from the tips of the electrodes forming the spark gap 13.

By enclosing the pre-spark gap 12, which controls discharge of the capacitor 14 within a chamber which is subject to gas under pressure, the energy loss within the pre-spark gap is substantially reduced, leaving more than previously available energy for igniting the fuel-air mixture within the combustion chamber by the ignition spark gap 13. The pressurized gas fill within the chamber 34 thus improves the overall efficiency of energy transfer from electrical energy being applied to terminal 11 to spark or ignition energy at the spark gap 13.

We claim:

1. Spark plug for combination with an Otto-type internal combustion engine having a head or connecting end and a spark end;

a metal housing (19);

an insulator (18) located within the metal housing and formed with a central opening therein;

an externally accessible high-voltage terminal (11, 24, 24') sealed into the insulator;

a central electrode (26) centrally located within the insulator, projecting from the insulator at an end remote from the externally accessible terminal and defining an ignition spark gap (13) with a counter electrode (30) secured to the metal housing;

a capacitor (14) located within the insulator and electrically connected in parallel to said ignition spark gap and dischargeable over said ignition spark gap (13);

a pilot or pre-discharge spark gap (12) located within the insulator and controlling discharge of the capacitor;

wherein the insulator comprises a two-part insulator structure having an end part portion (20) adjacent the spark end and a head part portion (21) adjacent the head end, said portions fitting telescopically within each other and being, respectively, dimensioned to leave a space therebetween defining a chamber (34);

said capacitor (14) and said pilot or pre-discharge spark gap (12) are located within said chamber; and said chamber is filled with a pressurized gas, to place the pilot or pre-spark gap (12) within a space subject to gas under elevated pressure.

2. Spark plug according to claim 1, wherein the gas pressure within said chamber (34) is between about 2 to 100 bar.

3. Spark plug according to claim 1, wherein the gas pressure within said chamber (34) is between about 5 to 30 bar.

4. Spark plug according to claim 3, wherein the gas within said chamber comprises nitrogen.

5. Spark plug according to claim 1, wherein the gas within said chamber comprises nitrogen.

6. Spark plug according to claim 1, wherein the center electrode (26) includes two electrode portions separated from each other and having electrode terminals (27, 28), which electrode terminals define said pilot or pre-discharge spark gap (12);

and wherein the spacing of said pre-spark gap electrode terminals, thereby defining said pre-spark gap, is between about 0.05 to 2 mm.

7. Spark plug according to claim 6, wherein the gas pressure within said chamber (34) is between about 2 to 100 bar.

8. Spark plug according to claim 7, wherein the gas within said chamber comprises nitrogen.

9. Spark plug according to claim 6, wherein the gas pressure within said chamber (34) is between about 5 to 30 bar.

10. Spark plug according to claim 9, wherein the gas within said chamber comprises nitrogen.

11. Spark plug according to claim 1, wherein the end portion (20) of the insulator includes a first sleeve-like portion (22) located adjacent the metal housing (19);

the head portion (21) of the insulator includes a second sleeve-like portion (23) extending within the first sleeve-like portion (22) and being spaced therefrom to define said chamber; and the head portion is formed with a shoulder to receive an end face of the first sleeve-like portion (22) and provide an engagement surface for said end face.

12. Spark plug according to claim 11, wherein the center electrode (26) includes two electrode portions separated from each other and having electrode terminals (27, 28), which electrode terminals define said pilot or pre-discharge spark gap; and a spacer sleeve (33) of insulating material is provided, located within the chamber (34), fitted between the electrode terminals (27, 28) and determining the spacing of said electrode terminals.

13. Spark plug according to claim 12, wherein the spacing of said pilot or pre-discharge spark gap electrode terminals, thereby defining said pilot or pre-spark gap, is between about 0.1 to 1 mm.

14. Spark plug according to claim 8, wherein the gas pressure within said chamber (34) is between about 2 to 100 bar.

15. Spark plug according to claim 14, wherein the gas within said chamber comprises nitrogen.

16. Spark plug according to claim 8, wherein the gas pressure within said chamber (34) is between about 5 to 30 bar.

17. Spark plug according to claim 16, wherein the gas within said chamber comprises nitrogen.

18. Spark plug according to claim 12, wherein the spacer sleeve (33) is telescopically received within said first sleeve-like portion (22) of the end portion (20) of the insulator.

19. Spark plug according to claim 11, wherein the capacitor (14) surrounds said second sleeve-like portion (23) of the head portion (21) of the insulator and is electrically connected to the metal housing (19) in the region of said shoulder.

* * * * *